United States Patent [19]

Strasser

[11] Patent Number: 4,815,054

[45] Date of Patent: Mar. 21, 1989

[54] MANUAL CONTROL DEVICE FOR A WATCH MOVEMENT

[75] Inventor: Joseph Strasser, Obfelden, Switzerland

[73] Assignee: Montres Longines Francillon S.A., Switzerland

[21] Appl. No.: 145,948

[22] Filed: Jan. 20, 1988

[30] Foreign Application Priority Data

Jan. 20, 1987 [CH] Switzerland ..... 00182/87

[51] Int. Cl.[4] ..... G04B 29/00

[52] U.S. Cl. ..... 368/319

[58] Field of Search ..... 368/319–321, 368/69, 70, 206, 185–187

[56] References Cited

FOREIGN PATENT DOCUMENTS 1833597 5/1961 Fed. Rep. of Germany .
180459 5/1931 Switzerland .
191764 9/1937 Switzerland .
216196 11/1941 Switzerland .
333586 10/1958 Switzerland ..... 368/319

*Primary Examiner*—Vit W. Miska
*Attorney, Agent, or Firm*—Pollock, Vande Sande & Priddy

[57] ABSTRACT

In order to enable a watch movement to be mounted in a case having a back cover integral with its case band, the manual control device of this movement comprises a shaft having a terminal pair of resilient claws. Notches are disposed in the claws and grip a pin disposed diametrically in the central housing of the crown. The body of the crown is manufactured in one piece with a sleeve engaging in a bore of the case band. The movement is inserted with the shaft by presenting in slantwise, then the crown is put into place by forcing the pin between the claws to introduce it into the notches.

11 Claims, 1 Drawing Sheet

MANUAL CONTROL DEVICE FOR A WATCH MOVEMENT

TECHNICAL FIELD OF THE INVENTION

The present invention relates to a manual control device for a watch movement intended to be housed in a case, particularly, but not exclusively, in a case having a back cover integral with its case band.

BACKGROUND OF THE INVENTION

In watch cases with an independent, detachable back, casing up and uncasing the watch movement is effected without the shaft for setting the time and, possibly, the calendar. This is placed in position after the movement has been introduced into the case, or removed before withdrawing the movement from the case. The fastening of this shaft to the movement, in the first instance, and its release, in the second, are customarily effected by actuating a post which is integral with the pull-out piece and only accessible from the back of the movement. This operation is simple when the back of the case may be removed. In cases having a back cover which is integral with the case band, i.e. in cases where the back and the case band are manufactured in one piece, this operation is, however, no longer possible.

DESCRIPTION OF THE PRIOR ART

The device generally used for many years for allowing a watch movement to be uncased and cased up in a case having a back cover integral with its case band consists in fitting a "broken" shaft made of two pieces which may be coupled together in a disconnectable manner.

One of these pieces presents a pair of notched resilient claws and the other presents near to its extremity a transversely widened portion or a transverse pin.

One of these pieces is retained in the watch movement by the pull-out piece and is short enough not to engage in the hole provided in the case band permitting the passage of the shaft. This piece thus does not hinder the uncasing or casing up of the watch movement.

The other of the above two pieces is fixed to the crown, for example by way of a thread provided at its extremity and screwed in a suitable threaded cylinder fitted to the bottom of the central hole of the crown.

These pieces interlock by firmly pushing the crown with its portion of shaft against the other part of the shaft in order to push the widened portion or the pin between the claws to introduce it into the notches of these latter. These two parts separate again by pulling the crown firmly towards the exterior of the casing. Such broken shafts are described, for example, in patents CH-A-180 459 and 191 764.

BRIEF SUMMARY OF THE INVENTION

It is an object of the invention to provide an analagous device, but of considerably simpler construction.

It results from the distinguishing features of the manual control device which are defined in claim 1 that the crown is extremely simple since it only presents a central cylindrical housing and a pin disposed diametrically in said housing. The part of the shaft that is fixed to the crown in the known devices and its fixing device to said crown are therefore no longer necessary.

A special embodiment has the defined in claim 2 have the additional advantage of substituting the sleeve of the crown for the tube generally fixed to the case in waterresistant watches. The space around the shaft in the bore of the case, which is free in the absence of the crown, makes it possible to case up and uncase the movement from the glass side of a case having a back cover integral with its case band. The movement can, indeed, be placed in an oblique position to the entrance of this case.

The part of the device which is solid with the shaft and has notched claws, can consist of an independent piece, screwed to the extremity of the shaft or driven onto and bonded to this extremity of the shaft. It can also be manufactured in one piece with the shaft. The passage of this shaft through the wall of the case band can be made waterproof by a waterproof joint mounted in a housing in the case band in such a way as to surround the sleeve of the crown. The pin gripped by the notches of the claws solid with the shaft can be arranged across the sleeve of the crown, beyond the waterproof joint, towards the interior of the case, if a leak is to be feared between this pin and the wall of the crown. Finally, depending on the position of the pin within the crown or if the movement provided with the control device has to be capable of being mounted in cases of different dimensions, various notches can be provided in sufficiently long claws. If necessary, the extremities of these claws can be removed.

BRIEF DESCRIPTION OF THE DRAWINGS

Two embodiments of the control device of the invention are schematically represented, solely for purposes of example, in the drawing in which.

DETAILED DESCRIPTION OF PREFERRED EMBODIMENTS OF THE INVENTION

Figure 1:
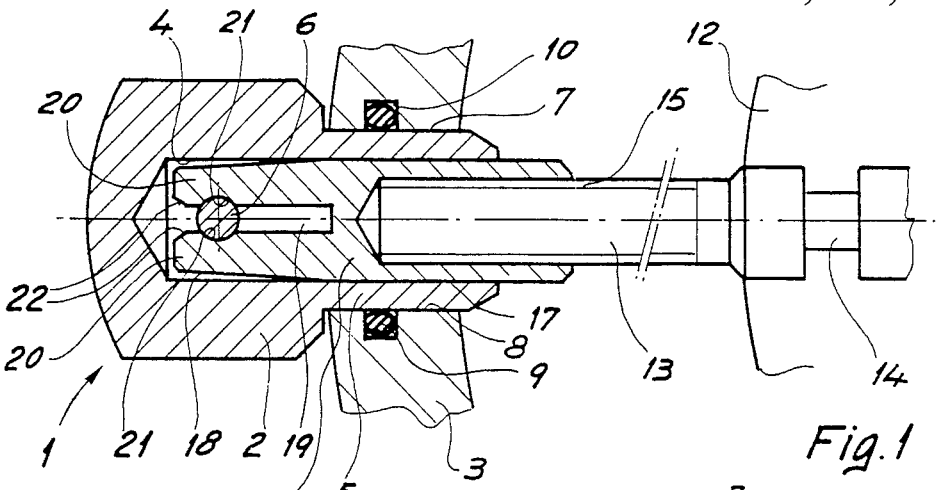
FIG. 1 is a diametrical section of the first embodiment.
Figure 2:
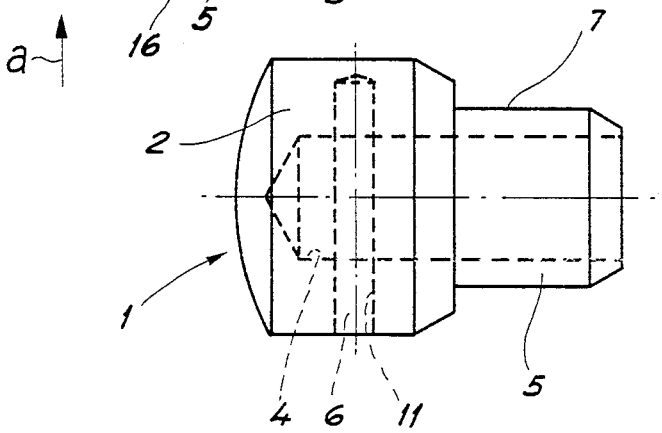
FIG. 2 is an elevation view of the crown of FIG. 1 along the direction of the arrow a, and FIG. 3 is a diametrical section of the second embodiment.

The control device of the first embodiment (FIGS. 1 and 2) comprises a crown 1, of which the body 2, outside the case band 3 of the case, is manufactured in one piece with a cylindrical sleeve 5 and presents a cylindrical housing 4. A pin 6 is lodged in a hole 11 pierced in the body 2 of the crown 1, and crosses the housing 4 diametrically. The outer surface 7 of the sleeve 5 is carefully polished so as to slide and turn freely in a bore 8, pierced through the wall of the case band 3.

The watertightness of the passage of the crown 1 through the case band 3 is ensured by a waterproof joint 9, of toroidal shape, which is disposed in a circular groove 10 of the case band 3. If the crown is solid, for example of gold, it will of course be necessary to ensure that the hole 11 pierced through the wall of its body 2 is perfectly filled by the pin 6 to prevent infiltration between these two pieces. On the other hand, if the crown 1 is made of base metal, it may be covered with a fine cap, for example of stainless steel, to seal the passage of the pin 6 through the wall of the body 2. In such a case, the pin 6 has obviously to be placed in position before that cap.

To control certain functions of the movement 12 of the watch, such as the setting of the time, the adjustment or correction of the calendar, a shaft 13 is mounted in the customary manner in the movement 12. It is retained in this latter by a pull-out piece stud (not shown) which penetrates a groove 14 of the shaft 13. The extremity of this latter that is outside the movement 12 presents a thread 15. A ferrule 16 is screwed firmly to that thread 15, so as to be solid with the shaft 13.

In another embodiment, not shown, the extremity of the shaft 13 is smooth and the ferrule 16 is driven onto and bonded to said extremity so as also to be solid with that shaft 13.

The outer surface 17 of the ferrule 16 is cylindrical. It engages freely in the sleeve 5. The exterior surface 18 of the extremity of the ferrule 16 is conical and presents a diametrical slot 19 so as to form two resilient claws 20. These claws 20 each have a notch 21. These notches 21 partially surround the pin 6 and hold it between them in such a way that the crown 1 is attached mechanically to the shaft 13 and that this latter also moves with every rotatory or translation movement imparted to the crown 1.

Although the ferrule 16, solid with the shaft 13 extends up to the exterior of the case band 3, the movement 12 equipped with the shaft 13 provided with the ferrule 16 can be cased up without difficulty. Due to the absence of a tube in the bore 8 of the case band 3, the ferrule 16 simply passes, in fact, through the bore 8 when the movement 12 is presented in an inclined position with respect to the case band 3. Uncasing is effected by first withdrawing from the case that part of the movement 12 which is diametrically opposed to the shaft 13.

To fasten the crown 1 to the shaft 13 when the movement 12 is in the case, it suffices to put the crown 1 onto the ferrule 16 in such a way that the pin 6 is parallel to the slot 19, and to firmly push the crown 1 towards the case band 3.

The pin 6 then forces the claws 20 apart which allow it to pass between them. The conical form of the surfaces 18 of the claws 20 permits their displacement into the interior of body 2. The pin 6 thus sits between the notches 21. The resilience of the claws 20 then causes the latter to urge against each other, which thus firmly holds the pin 6 between the notches 21.

To facilitate positioning of the pin 6 in relation to the slot 19, a chamfer 22 is provided along the inside edge of each of the claws 20.

If the movement 12 has to be uncased, the crown must first be removed. For this purpose it is separated from the case band 3 with a force sufficient to allow the pin 6 to escape from the claws 20 by separating them from one another.

The resilience of the claws 20 must clearly be determined as a function of the characteristics of the various pieces of the movement 12 which are linked to the shaft 13 in a manner such that the force necessary for removing the crown is greater than that which must be exerted to bring the crown 1 from its pushed in position to its pulled out position or positions, but inferior to that which the different pieces of the movement 12 can sustain without damage.

Figure 3:
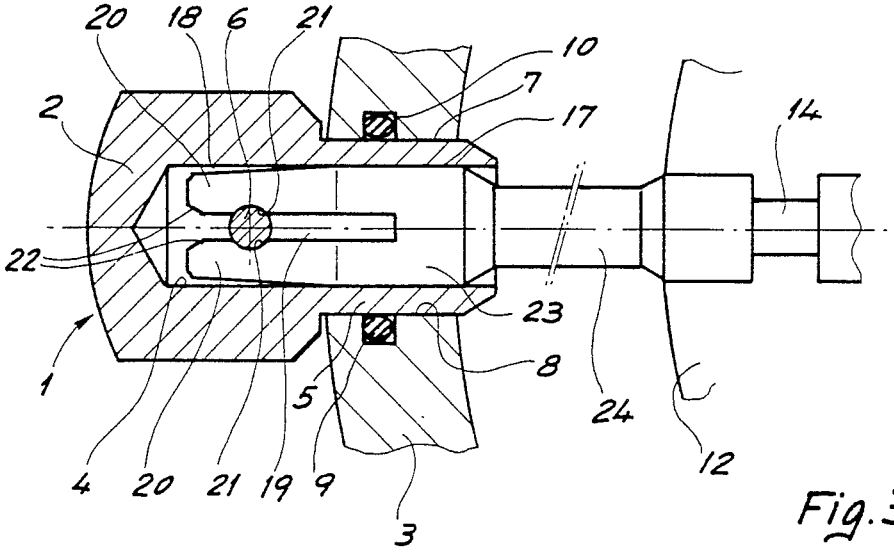

The second embodiment (FIG. 3) differs from the first solely in that the part 23 which replaces the ferrule 16 of the first embodiment is here manufactured as one integral piece with the shaft 24.

In this second embodiment the shaft 24 is thus manufactured at a specific length. But depending on the dimensions of the case designed to receive the movement it is necessary to adapt the length of the shaft to the latter. To permit such adaptation it suffices to make the part 23 sufficiently long, the slot 19 sufficiently deep and to provide a row of notches 21 along this slot.

Instead of locating the pin 6 in the body 2 of the crown 1 it could also pass through the sleeve 5 and be so situated therein that, at least when the crown 1 is in its pushed in position, it is situated beyond the waterproof joint 9 towards the interior of the case. There are thus avoided all problems of tightness which could arise if the pin 6 were not to completely fill the hole 11 in which it is placed. In this case it is of course necessary for the sleeve 5 to be sufficiently resistant to withstand the forces exerted on the pin 6 when the crown 1 is put into place or removed.

In order to avoid sideways movement of the ferrule 16 or the part 23 of the shaft 24 with respect to the crown 1 during its rotation, which would cause awkward variation of the torque to be exerted on the crown 1, it is appropriate to adjust the diameter of this ferrule 16 or this part 23 of the shaft 24 to that of the housing 4 of the crown 1.

Whilst the control device described is particularly advantageous in the case where the movement of the watch is intended to be mounted in a case having a back cover integral with its case band, there is of course nothing to prevent its use in cases where the movement of the watch is intended to be mounted in a case with an independent back.

I claim:

1. A manual control device for a watch movement intended to be mounted in a watch case, said control device comprising:

a shaft having a longitudinal axis, an outer end, an inner end rotatively coupled to said watch movement for allowing rotation of said shaft about said longitudinal axis;

a crown having a wall defining a central housing coaxial with said shaft; and, means for releasably coupling said crown to said shaft comprising:

a pair of resilient claws coupled to said outer end portion of said shaft and disposed in said central housing of said crown symmetrically to each other with respect to said longitudinal axis, a pair of notches one formed in each of said claws and disposed in a facing relationship to each other which is symmetrical with respect to said longitudinal axis, two holes bored in said wall of said crown, at least one of said holes being bored through said wall and said holes having a common axis intersecting said longitudinal axis of said shaft between said notches, and a pin having two ends one disposed in each of said holes and a middle portion disposed in said central housing and resiliently gripped by said claws between said notches such that said crown may be disconnected from said shaft by urging it away from the watch movement along said longitudinal axis of said shaft, and said crown may be reconnected to said shaft by urging said pin against said claws along said longitudinal axis of said shaft.

2. The control device of claim 1, wherein said claws form an integral, inseparable part with said shaft.

3. The control device of claim 1, wherein said claws comprise a common portion screwed onto said outer end of said shaft.

4. The control device of claim 1, wherein said wall of said crown comprises a cylindrical sleeve portion adapted to be engaged in a bore of the case band of said watch case, said bore being coaxial with said shaft.

5. The control device of claim 4, wherein said two holes are bored in said sleeve portion of said crown wall.

6. A manual control device for a watch movement intended to be mounted in a watch case having a case band and a back cover, said control device comprising:

a shaft having a longitudinal axis, an inner end rotatively coupled to said watch movement for allowing rotation of said shaft about said longitudinal axis, and an outer end portion intended to be positioned within a bore in said case band, said bore being coaxial with said shaft and defining an annular space around said outer end portion, and the amount of said annular space being sufficient for said watch movement to be cased up and uncased from the glass side of said case without removal of said back cover;

a crown having a wall defining a central housing coaxial with said shaft; and, means for releasably coupling said crown to said shaft comprising:

a pair of resilient claws coupled to said outer end portion of said shaft and disposed in said central housing of said crown, a pair of notches one formed in each of said claws and disposed in a facing relationship to each other, and a pin disposed across said central housing and resiliently gripped by said claws between said notches such that said crown may be disconnected from said shaft by urging it away from the watch movement along said longitudinal axis of said shaft, and said crown may be reconnected to said shaft by urging said pin against said claws along said longitudinal axis of said shaft, said crown wall comprising a sleeve portion which is adapted to rotate within said bore, and said sleeve portion substantially filling said annular space while said crown is connected to said shaft so as to engage said bore and said outer end portion of said shaft for avoiding sideways movement of said outer end portion when torque is exerted on said crown.

7. The control device of claim 6, wherein said crown includes two holes bored in said crown wall, at least one of said holes being bored through said crown wall and both of said holes having a common axis for intersecting said crown wall and said longitudinal axis of said shaft between said notches, and wherein said pin has two ends, one disposed in each of said holes and a middle portion disposed in said central housing to be resiliently gripped by said claws between said notches when said crown is connected to said shaft.

8. The control device of claim 6, wherein said outer end portion of said shaft is fixedly coupled to said shaft and comprises an independent ferrule screwed onto the extremity of said shaft.

9. The control device of claim 6, wherein said outer end portion of said shaft is fixedly coupled to said shaft and comprises an independent ferrule which is driven onto and bonded to the extremity of said shaft.

10. The control device of claim 6, wherein said outer end portion of said shaft is fixedly coupled to said shaft by being formed as an integral, inseparable part of said shaft.

11. The control device of claim 6, wherein said central housing is cylindrical in cross section.

* * * * *